US011028540B2

(12) United States Patent
Haven et al.

(10) Patent No.: US 11,028,540 B2
(45) Date of Patent: Jun. 8, 2021

(54) APPARATUS AND METHOD FOR A HOLD-DOWN ASSEMBLY

(71) Applicant: Carlson Paving Products, Inc., Tacoma, WA (US)

(72) Inventors: Cory Haven, Tacoma, WA (US); Kevin Comer, Buckley, WA (US)

(73) Assignee: Carlson Paving Products, Inc., Tacoma, WA (US)

( * ) Notice: Subject to any disclaimer, the term of this patent is extended or adjusted under 35 U.S.C. 154(b) by 76 days.

(21) Appl. No.: 16/584,456

(22) Filed: Sep. 26, 2019

(65) Prior Publication Data

US 2020/0095737 A1 Mar. 26, 2020

Related U.S. Application Data

(60) Provisional application No. 62/736,533, filed on Sep. 26, 2018.

(51) Int. Cl.
*E01C 19/42* (2006.01)
*E01C 19/48* (2006.01)

(52) U.S. Cl.
CPC ..... *E01C 19/4866* (2013.01); *E01C 19/42* (2013.01); *E01C 2301/10* (2013.01)

(58) Field of Classification Search
CPC ..... E01C 19/42; E01C 19/48; E01C 19/4866
USPC ..... 404/72–95, 118
See application file for complete search history.

(56) References Cited

U.S. PATENT DOCUMENTS

| | | | | |
|---|---|---|---|---|
| 6,318,928 | B1 * | 11/2001 | Swearingen | E01C 19/42 404/72 |
| 6,963,050 | B2 * | 11/2005 | Heindtel | E01C 19/48 219/213 |
| 8,113,737 | B2 * | 2/2012 | Mahler | E01C 19/4833 404/95 |
| 8,517,630 | B2 * | 8/2013 | Graham | E01C 19/48 404/118 |
| 9,181,662 | B2 * | 11/2015 | Kopacz | E01C 19/48 |
| 9,885,158 | B2 * | 2/2018 | Grimm | E01C 19/48 |
| 10,017,905 | B2 * | 7/2018 | Young, Jr. | E01C 19/4873 |
| 10,156,049 | B1 * | 12/2018 | Frost | E01C 19/48 |
| 10,538,886 | B2 * | 1/2020 | Buschmann | E01C 19/48 |
| 10,662,592 | B1 * | 5/2020 | Berns | E01C 19/48 |

(Continued)

FOREIGN PATENT DOCUMENTS

WO WO 2014204743 * 12/2014 ..... E01C 19/72

*Primary Examiner* — Raymond W Addie
(74) *Attorney, Agent, or Firm* — Chambliss, Bahner & Stophel, P.C.

(57) ABSTRACT

A heating element hold-down assembly having a heating element adapted to be removably mounted on the screed and a hold-down mechanism adapted to be removably mounted on the screed. The hold-down mechanism comprises a hold-down mechanism frame adapted to contact the heating element, a resilient device adapted to move between an expanded position and a contracted position, a tension shaft, a portion of which is adapted to contact the resilient device, a pin adapted to removably attach the tension shaft to the hold-down mechanism frame, and an adjustment means adapted to be adjustably connected to the screed frame so as to contact the tension shaft. The hold-down mechanism is adapted to maintain contact between the heating element and the screed plate when the screed moves, flexes, or is adjusted.

20 Claims, 7 Drawing Sheets

(56) References Cited

U.S. PATENT DOCUMENTS

| | | | | |
|---|---|---|---|---|
| 2011/0002738 | A1* | 1/2011 | Mahler | E01C 19/4833<br>404/118 |
| 2014/0377003 | A1* | 12/2014 | Kopacz | E01C 19/42<br>404/118 |
| 2016/0186389 | A1* | 6/2016 | Graham | E01C 19/48<br>404/79 |

* cited by examiner

APPARATUS AND METHOD FOR A HOLD-DOWN ASSEMBLY

CROSS-REFERENCES TO RELATED APPLICATIONS/PATENTS

This application relates back to and claims the benefit of priority from U.S. Provisional Application for Patent Ser. No. 62/736,533 titled "Hold-Down Assembly" and filed on Sep. 26, 2018.

FIELD OF THE INVENTION

The present invention relates generally to apparatuses and methods for screeds used on paving machines, and particularly to apparatuses and methods for screeds having hold-down assemblies for heating elements.

BACKGROUND AND DESCRIPTION OF THE PRIOR ART

It is known to use apparatuses and methods for screeds having hold-down assemblies for heating elements. Conventional apparatuses and methods, however, suffer from one or more disadvantages. For example, in conventional apparatuses and methods, the heating element of the screed does not remain in desirably close proximity to the screed plate when the screed plate moves, flexes, or is adjusted. As a result, conventional apparatuses and methods inefficiently transmit heat from the heating element to the screed plate when the screed plate moves, flexes, or is adjusted. Further, in conventional apparatuses and methods, it is undesirably difficult to access the heating element and hold-down assembly for removal, adjustment, repair, maintenance, replacement, and the like. As a result, in conventional apparatuses and methods, removal, adjustment, repair, maintenance, and replacement of the heating element and hold-down assembly are undesirably time-consuming and labor-intensive and require the removal of additional parts of the screed. Still further, in conventional apparatuses and methods, the removal of the screed plate requires the removal of other screed parts, including the heating element and hold-down assembly. As a result, in conventional apparatuses and methods, removal and replacement of the screed plate are undesirably time-consuming and labor-intensive and require the removal and replacement of other parts such as the heating element. In addition, in some conventional apparatuses and methods, the hold-down assembly is undesirably mounted to the screed frame. As a result, in some conventional apparatuses and methods, when the screed plate is adjusted and the spacing between the screed plate and the screed frame changes, the heating element either loses contact with the screed plate or gets damaged by the screed plate without an additional manual adjustment of the hold-down assembly.

It would be desirable, therefore, if an apparatus and method for a heating element hold-down assembly could be provided in which the heating element of the screed remains in close proximity to the screed plate when the screed plate moves, flexes, or is adjusted. It would also be desirable if such an apparatus and method for a heating element hold-down assembly could be provided that would efficiently transmit heat from the heating element to the screed plate when the screed plate moves, flexes, or is adjusted. It would be further desirable if such an apparatus and method for a heating element hold-down assembly could be provided that would provide easy access to the heating element and hold-down assembly for removal, adjustment, repair, maintenance, replacement, and the like. It would be still further desirable if such an apparatus and method for a heating element hold-down assembly could be provided in which removal, adjustment, repair, maintenance, and replacement of the heating element and hold-down assembly are less time-consuming and labor-intensive and do not require the removal of additional parts of the screed. In addition, it would be desirable if such an apparatus and method for a heating element hold-down assembly could be provided that would not be mounted to the screed frame. It would also be desirable if such an apparatus and method for a heating element hold-down assembly could be provided in which the heating element does loses contact with the screed plate or get damaged by the screed plate without an additional manual adjustment of the hold-down assembly when the screed plate is adjusted and the spacing between the screed plate and the screed frame changes.

ADVANTAGES OF THE PREFERRED EMBODIMENTS OF THE INVENTION

Accordingly, it is an advantage of the preferred embodiments of the invention claimed herein to provide an apparatus and method for a heating element hold-down assembly in which the heating element of the screed remains in close proximity to the screed plate when the screed plate moves, flexes, or is adjusted. It is also an advantage of the preferred embodiments of the invention claimed herein to provide an apparatus and method for a heating element hold-down assembly that would efficiently transmit heat from the heating element to the screed plate when the screed plate moves, flexes, or is adjusted. It is another advantage of the preferred embodiments of the invention claimed herein to provide an apparatus and method for a heating element hold-down assembly that provide easy access to the heating element and hold-down assembly for removal, adjustment, repair, maintenance, replacement, and the like. It is still another advantage of the preferred embodiments of the invention claimed herein to provide an apparatus and method for a heating element hold-down assembly in which removal, adjustment, repair, maintenance, and replacement of the heating element and hold-down assembly are less time-consuming and labor-intensive and do not require the removal of additional parts of the screed. It is yet another advantage of the preferred embodiments of the invention claimed herein to provide an apparatus and method for a heating element hold-down assembly that would not be mounted to the screed frame. In addition, it is an advantage of the preferred embodiments of the invention claimed herein to provide an apparatus and method for a heating element hold-down assembly in which the heating element does loses contact with the screed plate or get damaged by the screed plate without an additional manual adjustment of the hold-down assembly when the screed plate is adjusted and the spacing between the screed plate and the screed frame changes.

Additional advantages of the preferred embodiments of the invention will become apparent from an examination of the drawings and the ensuing description.

EXPLANATION OF THE TECHNICAL TERMS

The use of the terms "a," "an," "the," and similar terms in the context of describing the invention are to be construed to cover both the singular and the plural, unless otherwise indicated herein or clearly contradicted by context. The terms "comprising" "having," "including," and "containing" are to be construed as open-ended terms (i.e., meaning "including, but not limited to,") unless otherwise noted. The terms "substantially," "generally," and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic. All methods described herein can be performed in any suitable order unless otherwise specified herein or clearly indicated by context.

Terms concerning attachments, coupling and the like, such as "attached," "connected," and "interconnected," refer to a relationship wherein structures are secured or attached to one another either directly or indirectly through intervening structures, as well as both moveable and rigid attachments or relationships, unless specified herein or clearly indicated by context. The term "operatively connected" is such an attachment, coupling or connection that allows the pertinent structures to operate as intended by virtue of that relationship.

The use of any and all examples or exemplary language (e.g., "such as," "preferred," and "preferably") herein is intended merely to better illuminate the invention and the preferred embodiments thereof, and not to place a limitation on the scope of the invention. Nothing in the specification should be construed as indicating any element as essential to the practice of the invention unless so stated with specificity. Several terms are specifically defined herein. These terms are to be given their broadest reasonable construction consistent with such definitions, as follows:

As used herein, the term "actuator" means any device, mechanism, assembly or combination thereof that is adapted to move or be moved between a retracted position and an extended position so as to impart a mechanical force. The term "actuator" includes without limitation linear actuators, rotary actuators, hydraulic cylinders, hydraulic rotary actuators, pneumatic cylinders, springs and the like.

As used herein, the term "resilient device" means any device, mechanism, assembly or combination thereof that is adapted to return to or recover its original size, shape, form, or position when a deforming force or pressure is removed. The term "resilient device" includes, without limitation, a coil spring, a leaf spring, a torsion bar, pneumatic fluid device, hydraulic fluid device, working fluid device, a gas charged shock, an elastomeric material, and combinations thereof.

SUMMARY OF THE INVENTION

The apparatus of the invention comprises a heating element hold-down assembly adapted for use on a screed having a screed frame and a screed plate. The preferred heating element hold-down assembly comprises a heating element that is adapted to be removably mounted on the screed and a hold-down mechanism that is adapted to be removably mounted on the screed. The preferred hold-down mechanism comprises a hold-down mechanism frame that is adapted to contact the heating element, a resilient device that is adapted to move between an expanded position and a contracted position, a tension shaft, a portion of which is adapted to contact the resilient device, a pin that is adapted to removably attach the tension shaft to the hold-down mechanism frame, and an adjustment means that is adapted to be adjustably connected to the screed frame so as to contact the tension shaft. The preferred hold-down mechanism is adapted to maintain contact between the heating element and the screed plate when the screed moves, flexes, or is adjusted.

The method of the invention comprises a method for maintaining contact between a screed plate and a heating element in a screed. The preferred method comprises providing a heating element hold-down assembly adapted for use on a screed having a screed frame and a screed plate. The preferred heating element hold-down assembly comprises a heating element that is adapted to be removably mounted on the screed and a hold-down mechanism that is adapted to be removably mounted on the screed. The preferred hold-down mechanism comprises a hold-down mechanism frame that is adapted to contact the heating element, a resilient device that is adapted to move between an expanded position and a contracted position, a tension shaft, a portion of which is adapted to contact the resilient device, a pin that is adapted to removably attach the tension shaft to the hold-down mechanism frame, and an adjustment means that is adapted to be adjustably connected to the screed frame so as to contact the tension shaft. The preferred hold-down mechanism is adapted to maintain contact between the heating element and the screed plate when the screed moves, flexes, or is adjusted. The preferred method further comprises moving the resilient device between the expanded position and the contracted position.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
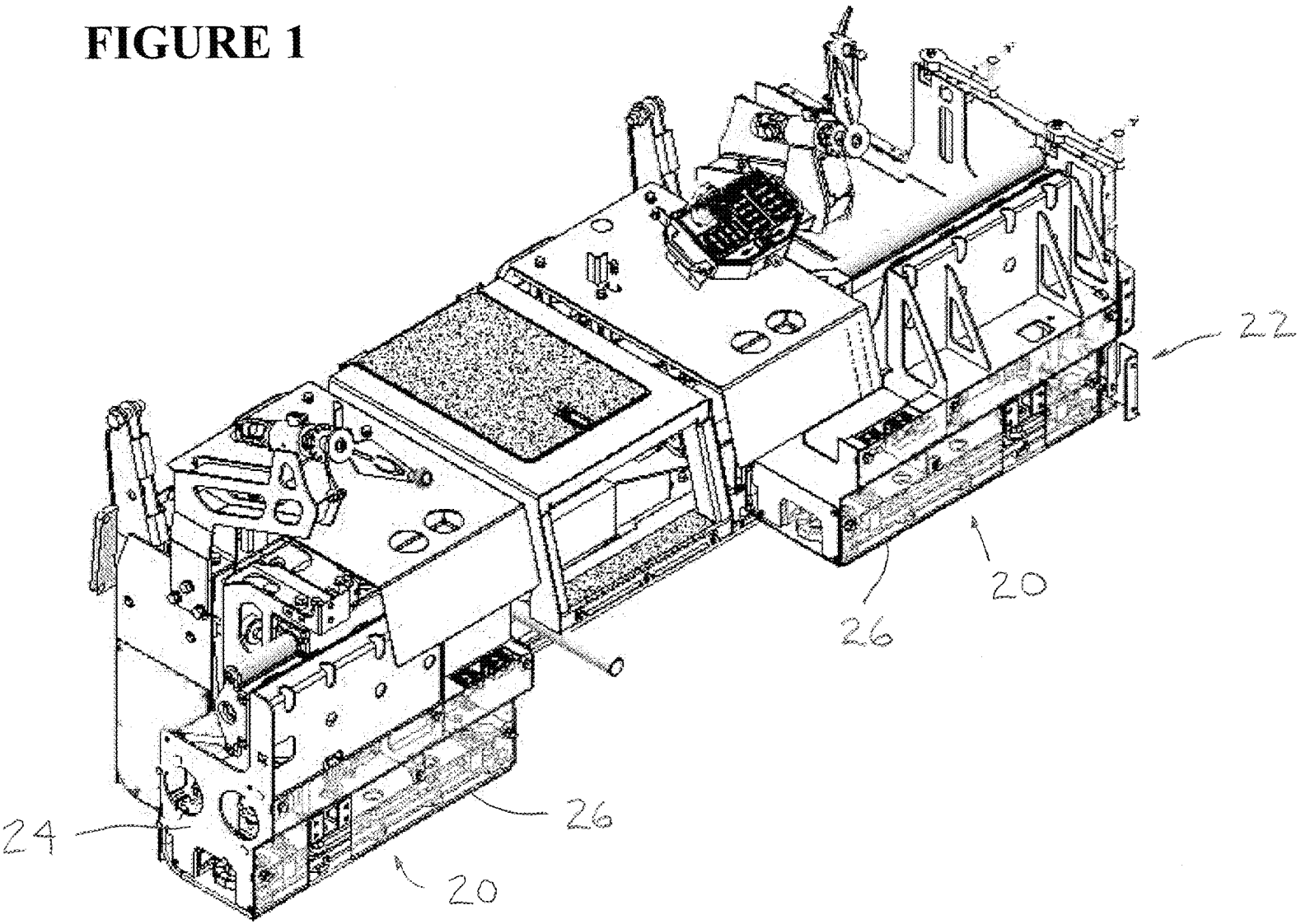
FIG. 1 is a back perspective view of the preferred embodiment of the heating element hold-down assembly in accordance with the present invention shown on an exemplary screed.

Referring now to the drawings, the preferred embodiment of the heating element hold-down assembly in accordance with the present invention is illustrated by FIGS. 1 through 8. As shown in FIGS. 1-8, the heating element of the preferred heating element hold-down assembly remains in close proximity to the screed plate when the screed plate moves, flexes, or is adjusted. The preferred heating element hold-down assembly also efficiently transmits heat from the heating element to the screed plate when the screed plate moves, flexes, or is adjusted. The preferred heating element hold-down assembly further provides easy access to the heating element and hold-down assembly for removal, adjustment, repair, maintenance, replacement, and the like. The preferred heating element hold-down assembly still further makes removal, adjustment, repair, maintenance, and replacement of the heating element and hold-down assembly are less time-consuming and labor-intensive and does not require the removal of additional parts of the screed. In addition, the preferred heating element hold-down assembly is not mounted to the screed frame. The preferred heating element hold-down assembly also maintains contact with the screed plate without an additional manual adjustment of the hold-down assembly when the screed plate is adjusted and the spacing between the screed plate and the screed frame changes. As a result, the preferred heating element hold-down assembly does not get damaged by the screed plate.

Referring now to FIG. 1, a back perspective view of the preferred embodiment of the heating element hold-down assembly in accordance with the present invention shown on an exemplary screed is illustrated. As shown in FIG. 1, the preferred heating element hold-down assembly 20 is designated generally by reference numeral 20 and exemplary screed is designated generally by reference numeral 22. Exemplary screed 22 comprises screed frame 24 and screed plate 26.

Figure 2:
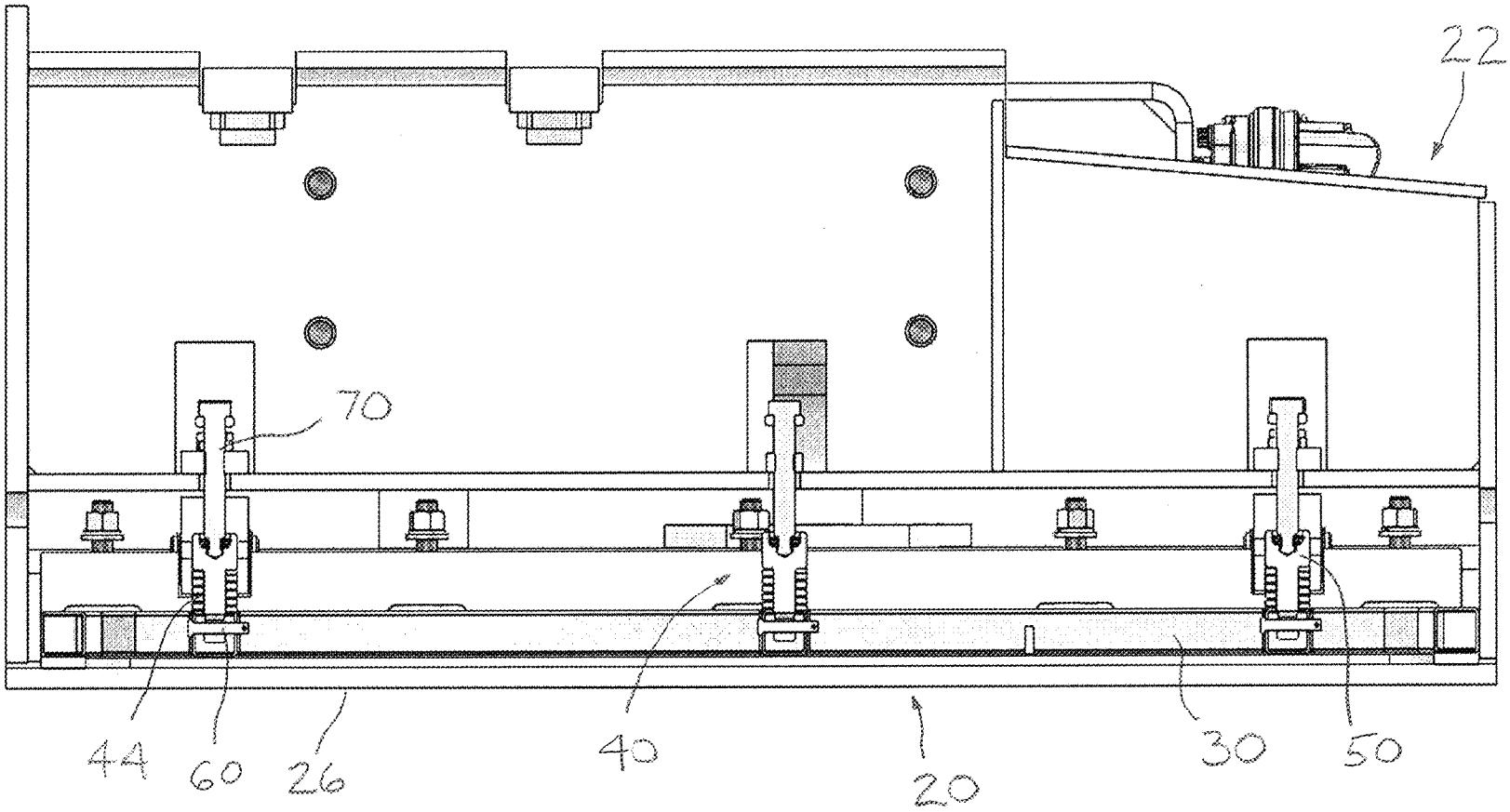
FIG. 2 is a back view of the preferred heating element hold-down assembly illustrated in FIG. 1.

Referring now to FIG. 2, a back view of preferred heating element hold-down assembly 20 is illustrated. As shown in FIG. 2, preferred heating element hold-down assembly 20 comprises heating element 30 and hold-down mechanism 40. Preferred heating element 30 is adapted to be removably mounted on the screed. Preferably, heating element 30 is adapted to be removed from screed 22 without removing screed plate 26 and screed plate 26 is adapted to be removed from screed 22 without removing heating element 30. Further, in the preferred embodiments of heating element hold-down assembly 20, heating element 30 and the hold-down mechanism 40 are adapted to be removed from screed 22 as a unit without removing screed plate 26. Still further, in the preferred embodiments of heating element hold-down assembly 20, screed plate 26 is adapted to be removed from screed 22 without removing hold-down mechanism 40.

Still referring to FIG. 2, preferred hold-down mechanism 40 is adapted to be removably mounted on screed 22 or screed frame 24. Preferred hold-down mechanism 40 also comprises one or more resilient devices such as springs 44 which are adapted to move between an expanded position and a contracted position. Preferably, resilient device comprises one or more springs, but it is contemplated within the scope of the invention that the resilient device may be any suitable composition of matter, device, mechanism, assembly, or combination thereof that is adapted to move between an expanded position and a contracted position.

Still referring to FIG. 2, preferred heating element hold-down assembly 20 further comprises tension shaft 50. Preferably, a portion of tension shaft 50 is adapted to contact the resilient device such as spring 44. Preferred heating element hold-down assembly 20 still further comprises a means for removably attaching the heating element and the hold-down mechanism such as pin 60. Preferred pin 60 is adapted to removably attach tension shaft 50 to hold-down mechanism frame 42. Preferred hold-down frame 42 is adapted to contact heating element 30. While the preferred means for removably attaching the heating element and the hold-down mechanism comprises pin 60, it is contemplated within the scope of the invention that the means for removably attaching the heating element and the hold-down mechanism may be any suitable device, mechanism, assembly, or combination thereof such as a threaded fastener, rivet, rod, tube, cylinder, peg, and the like. In addition, preferred heating element hold-down assembly 20 comprises an adjustment means such as jack screws 70. Preferred jack screws 70 are adjustably connected to screed frame 24 so as to contact tension shaft 50. In the preferred embodiments of heating element hold-down assembly 20, hold-down mechanism 40 is adapted to maintain contact between heating element 30 and screed plate 26 when screed 22 moves, flexes, or is adjusted. While the preferred adjustment means comprise one or more jack screws 70, it is also contemplated within the scope of the invention that the adjustment means may comprise one or more actuators.

Figure 3:
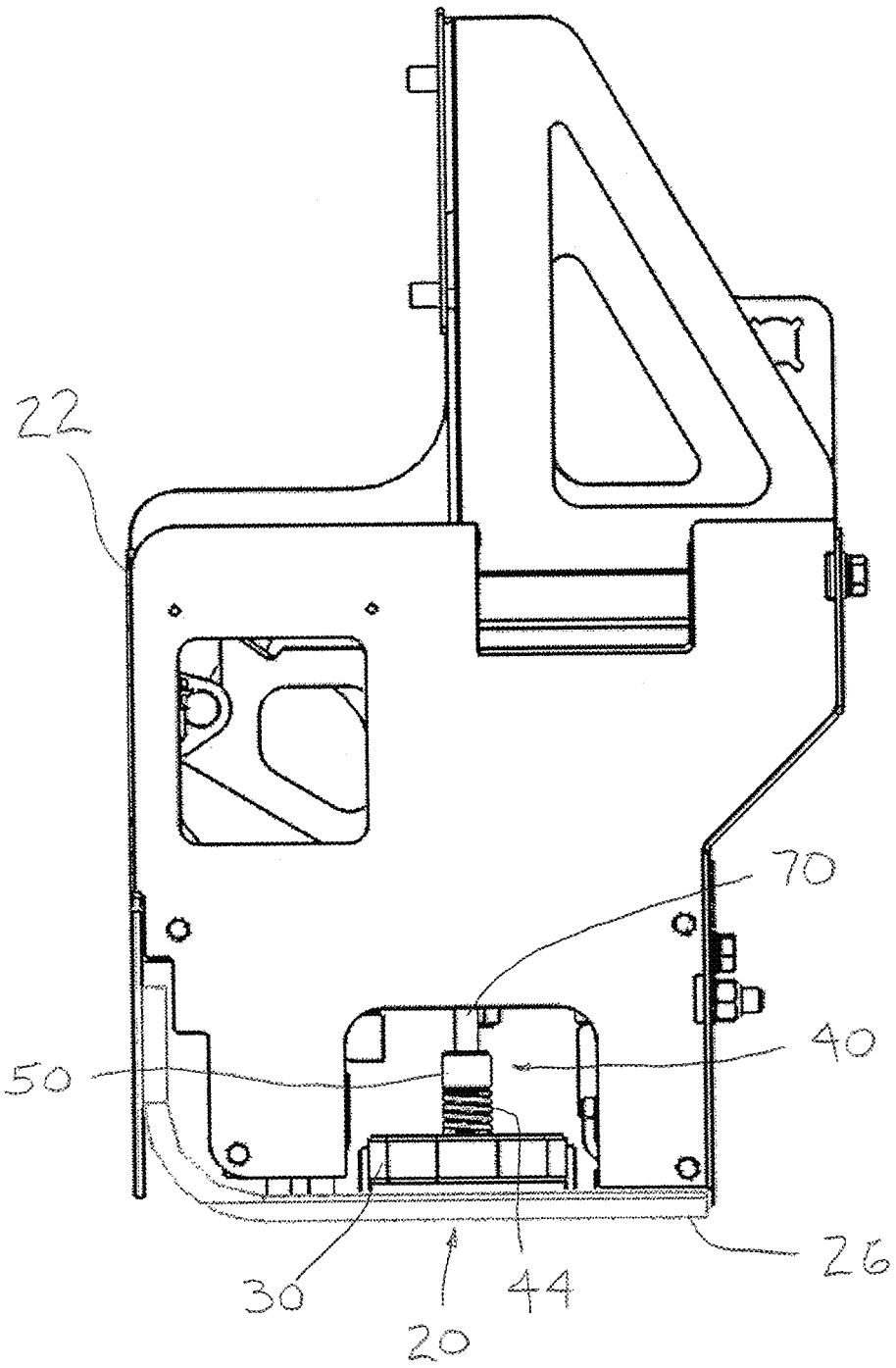
FIG. 3 is a right side view of the preferred heating element hold-down assembly illustrated in FIGS. 1-2.

Referring now to FIG. 3, a right side view of preferred heating element hold-down assembly 20 is illustrated on exemplary screed 22 having screed plate 26. As shown in FIG. 3, preferred heating element hold-down assembly 20 comprises heating element 30, hold-down mechanism 40, spring 44, tension shaft 50, and jack screw 70.

Figure 4:
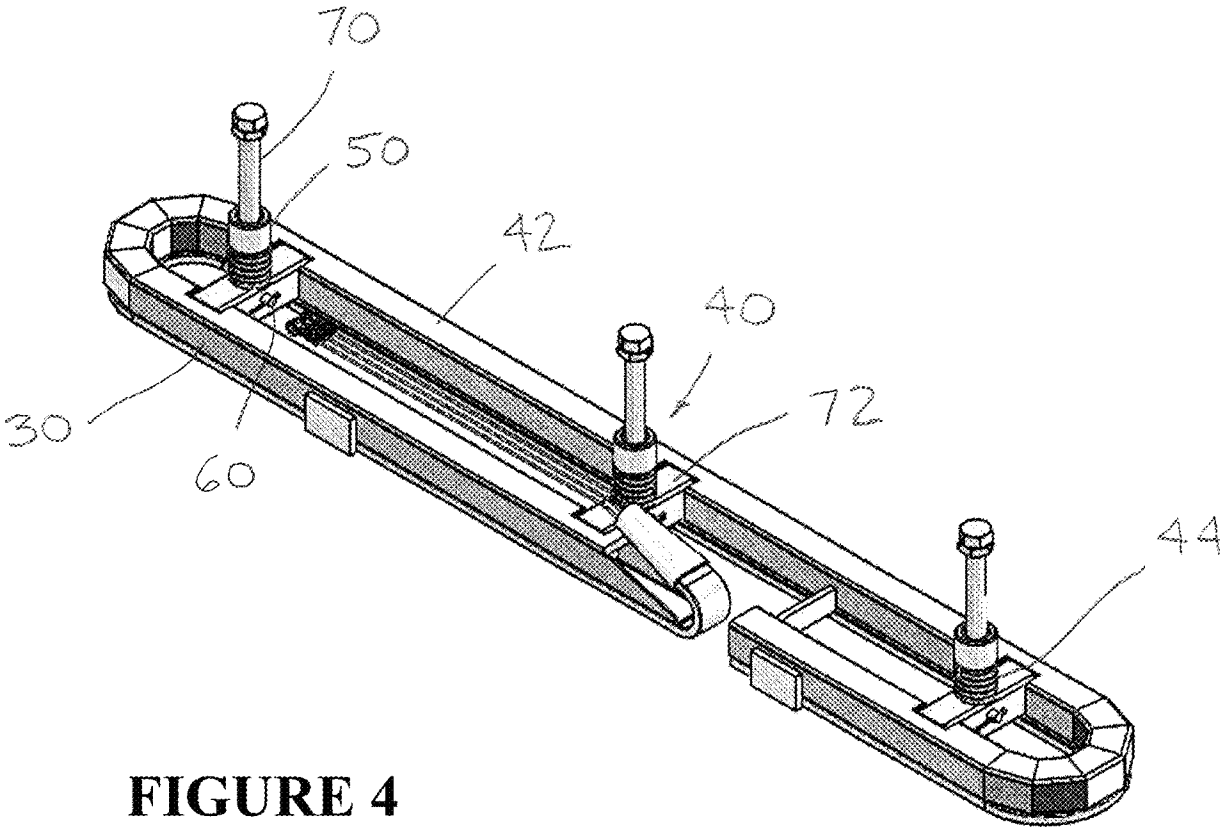
FIG. 4 is a perspective isolated view of the preferred heating element hold-down assembly illustrated in FIGS. 1-3.

Referring now to FIG. 4, a perspective isolated view of preferred heating element hold-down assembly 20 is illustrated. As shown in FIG. 4, preferred heating element hold-down assembly 20 comprises heating element 30, hold-down mechanism 40, hold-down mechanism frame 42, spring 44, tension shaft 50, jack screws 70, and cross members 72.

Figure 5:
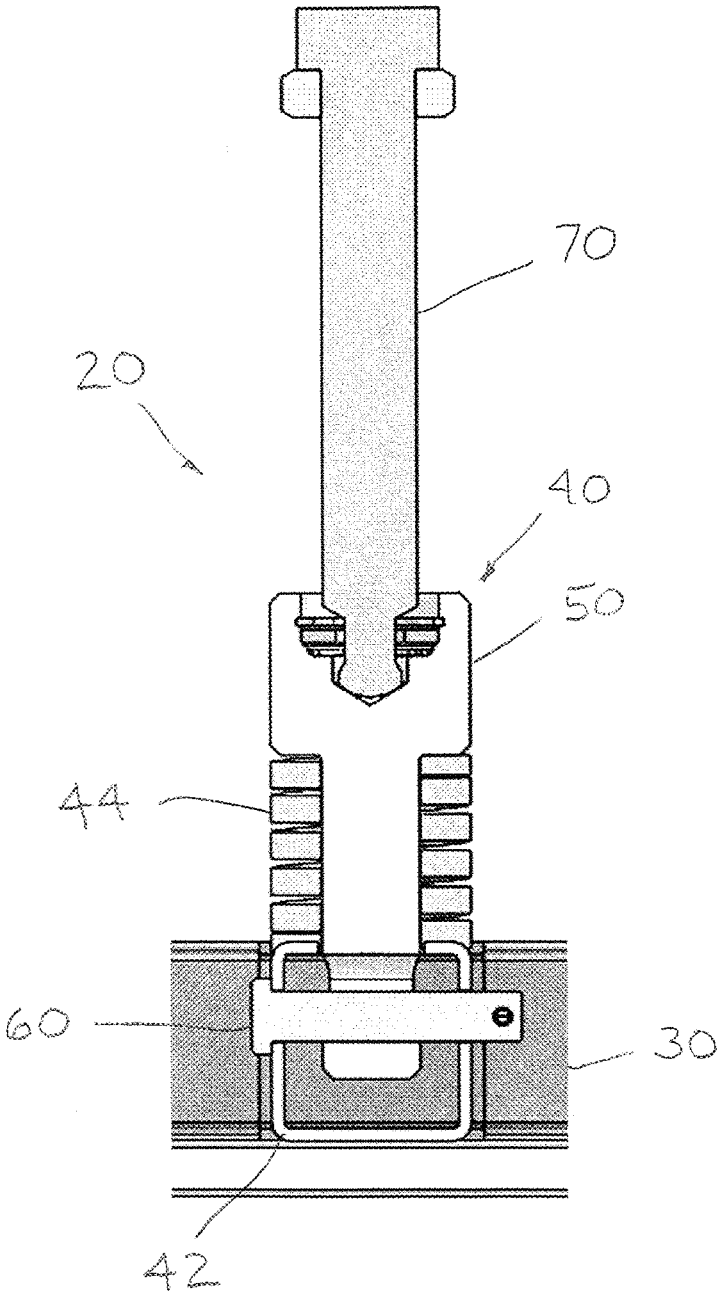
FIG. 5 is a back isolated view of a subassembly of the preferred heating element hold-down assembly illustrated in FIGS. 1-4.

Referring now to FIG. 5, a back isolated view of a subassembly of preferred heating element hold-down assembly 20 is illustrated. As shown in FIG. 5, preferred heating element hold-down assembly 20 comprises heating element 30, hold-down mechanism 40, hold-down mechanism frame 42, spring 44, tension shaft 50, pin 60, and jack screws 70.

Figure 6:
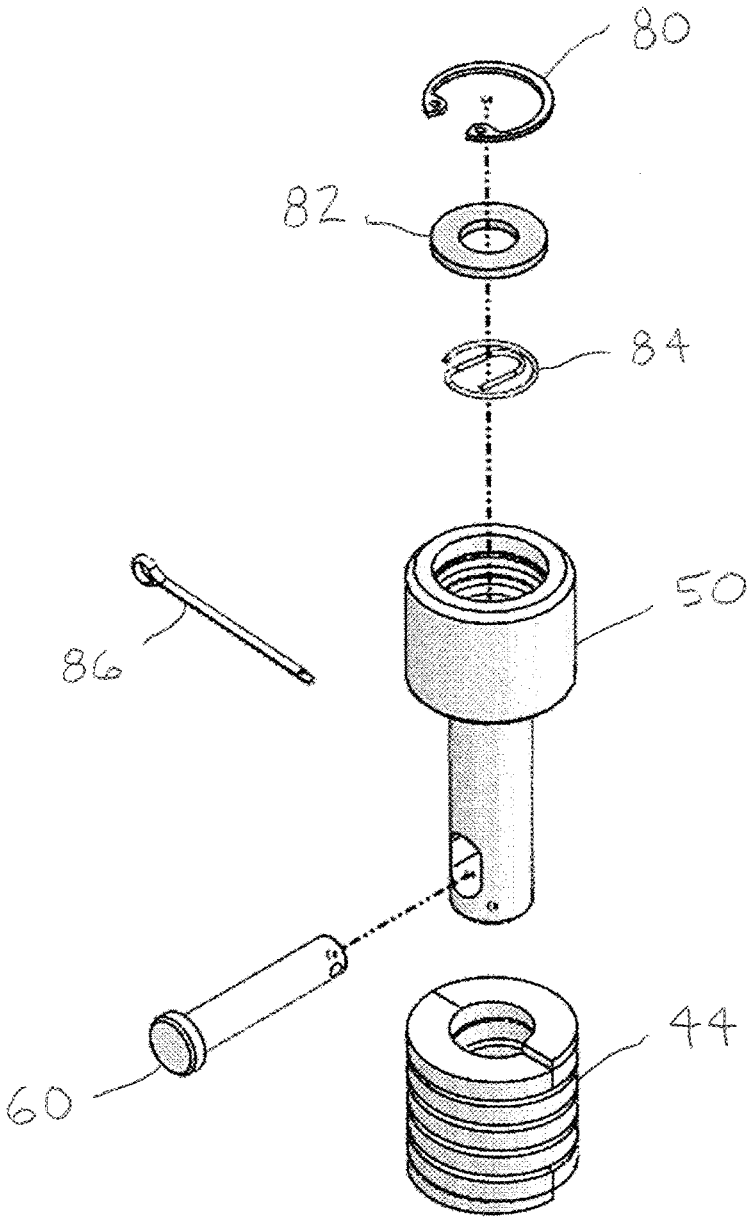
FIG. 6 is an exploded isolated view of a subassembly of the preferred heating element hold-down assembly illustrated in FIGS. 1-5.

Referring now to FIG. 6, an exploded isolated view of a subassembly of preferred heating element hold-down assembly 20 is illustrated. As shown in FIG. 6, preferred heating element hold-down assembly 20 comprises spring 44, tension shaft 50, and pin 60. In addition, preferred heating element hold-down assembly 20 comprises retaining ring 80, retaining washer 82, spring ring 84, and retaining pin 86. Preferred spring ring 84 is adapted to removably hold that ball end of the jack screw in tension shaft 50 such that the jack screw can be easily and quickly disconnected from the tension shaft and misalignment of the jack screw and the tension shaft is tolerated. While a spring ring is the simplest and preferred means for removably holding the ball end of the jack screw in the tension shaft, it is contemplated within the scope of the invention that the means for removably holding the ball end of the jack screw in the tension may be any suitable device, mechanism, assembly, or combination thereof.

Figure 7:
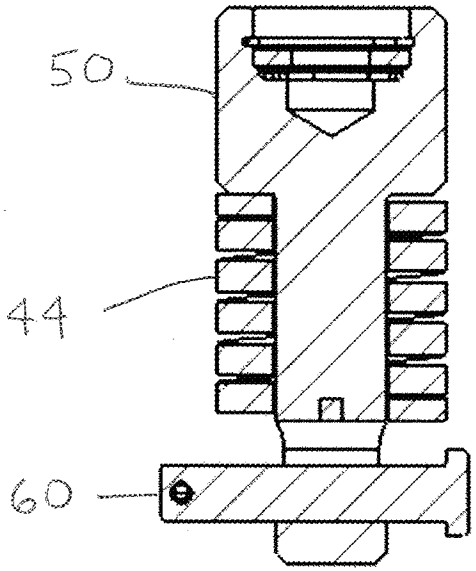
FIG. 7 is a front isolated view of a subassembly of the preferred heating element hold-down assembly illustrated in FIGS. 1-6.

Referring now to FIG. 7, a front isolated view of a subassembly of preferred heating element hold-down assembly 20 is illustrated. As shown in FIG. 7, preferred heating element hold-down assembly 20 comprises spring 44, tension shaft 50, and pin 60.

Figure 8:
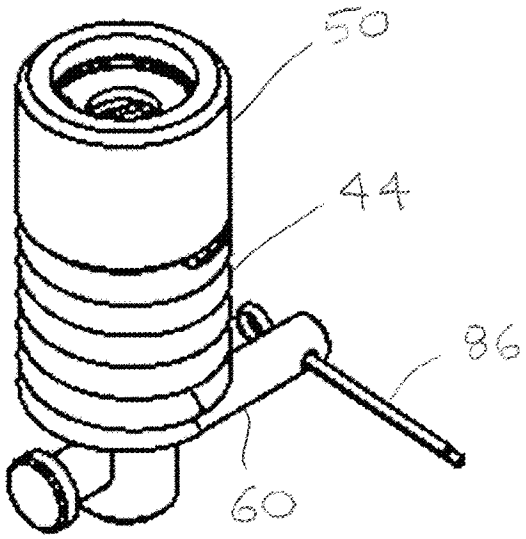
FIG. 8 is a perspective isolated view of a subassembly of the preferred heating element hold-down assembly illustrated in FIGS. 1-7.

Referring now to FIG. 8, a perspective isolated view of a subassembly of preferred heating element hold-down assembly 20 is illustrated. As shown in FIG. 8, preferred heating element hold-down assembly 20 comprises spring 44, tension shaft 50, pin 60, and retaining pin 86.

The invention also comprises a method for maintaining contact between a screed plate and a heating element in a screed. The preferred method comprises providing a heating element hold-down assembly adapted for use on a screed having a screed frame and a screed plate. The preferred heating element hold-down assembly comprises a heating element that is adapted to be removably mounted on the screed and a hold-down mechanism that is adapted to be removably mounted on the screed. The preferred hold-down mechanism comprises a hold-down mechanism frame that is adapted to contact the heating element, a resilient device that is adapted to move between an expanded position and a contracted position (or an extended and a retracted position), a tension shaft, a portion of which is adapted to contact the resilient device, a pin that is adapted to removably attach the tension shaft to the hold-down mechanism frame, and an adjustment means that is adapted to be adjustably connected to the screed frame so as to contact the tension shaft. The preferred hold-down mechanism is adapted to maintain contact between the heating element and the screed plate when the screed moves, flexes, or is adjusted. The preferred method further comprises moving the resilient device between the expanded position and the contracted position. In other preferred embodiments, the method comprises adjusting the heating element hold-down mechanism.

In operation, several advantages of the preferred embodiments of the material discharge device are achieved. For example, the heating element of the preferred heating element hold-down assembly remains in close proximity to the screed plate when the screed plate moves, flexes, or is adjusted. The preferred heating element hold-down assembly also efficiently transmits heat from the heating element to the screed plate when the screed plate moves, flexes, or is adjusted. The preferred heating element hold-down assembly further provides easy access to the heating element and hold-down assembly for removal, adjustment, repair, maintenance, replacement, and the like. The preferred heating element hold-down assembly still further makes removal, adjustment, repair, maintenance, and replacement of the heating element and hold-down assembly are less time-consuming and labor-intensive and does not require the removal of additional parts of the screed. In addition, the preferred heating element hold-down assembly is not mounted to the screed frame. The preferred heating element hold-down assembly also maintains contact with the screed plate without an additional manual adjustment of the hold-down assembly when the screed plate is adjusted and the spacing between the screed plate and the screed frame changes. As a result, the preferred heating element hold-down assembly does not get damaged by the screed plate.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. A heating element hold-down assembly adapted for use on a screed having a screed frame and a screed plate, said heating element hold-down assembly comprising:

(a) a heating element, said heating element being adapted to be removably mounted on the screed;

(b) a hold-down mechanism, said hold-down mechanism being removably mounted on the screed and comprising:

(i) a hold-down mechanism frame, said hold-down mechanism frame being adapted to contact the heating element;

(ii) a resilient device, said resilient device being adapted to move between an expanded position and a contracted position;

(iii) a tension shaft, a portion of said tension shaft being adapted to contact the resilient device;

(iv) a means for removably attaching the tension shaft to the hold-down mechanism frame, said means for removably attaching the tension shaft to the hold-down mechanism frame being disposed in the lower portion of the tension shaft;

(v) an adjustment means, said adjustment means being adjustably connected to the screed frame so as to contact the tension shaft;

wherein the hold-down mechanism is adapted to maintain contact between the heating element and the screed plate when the screed moves, flexes, or is adjusted.

2. The heating element hold-down assembly of claim 1 wherein the hold-down mechanism further comprises a retaining ring.

3. The heating element hold-down assembly of claim 1 wherein the hold-down mechanism further comprises a retaining washer.

4. The heating element hold-down assembly of claim 1 wherein the hold-down mechanism further comprises a spring ring.

5. The heating element hold-down assembly of claim 1 wherein the hold-down mechanism further comprises a means for removably attaching the heating element and the hold-down mechanism.

6. The heating element hold-down assembly of claim 1 wherein the means for removably attaching the heating element and the hold-down mechanism comprises a pin.

7. The heating element hold-down assembly of claim 1 wherein the hold-down mechanism is removably mounted to the screed frame.

8. The heating element hold-down assembly of claim 1 wherein the hold-down mechanism frame further comprises one or more cross-members.

9. The heating element hold-down assembly of claim 1 wherein the resilient device comprises a spring.

10. The heating element hold-down assembly of claim 1 wherein the adjustment means comprises a jack screw.

11. The heating element hold-down assembly of claim 1 wherein the adjustment means comprises an actuator.

12. The heating element hold-down assembly of claim 1 wherein the heating element is adapted to be removed from the screed without removing the screed plate.

13. The heating element hold-down assembly of claim 1 wherein the hold-down mechanism is adapted to be removed from the screed without removing the screed plate.

14. The heating element hold-down assembly of claim 1 wherein the heating element and the hold-down mechanism are adapted to be removed from the screed as a unit.

15. The heating element hold-down assembly of claim 1 wherein the heating element and the hold-down mechanism are adapted to be removed from the screed as a unit without removing the screed plate.

16. The heating element hold-down assembly of claim 1 wherein the screed plate is adapted to be removed from the screed without removing the heating element.

17. The heating element hold-down assembly of claim 1 wherein the screed plate is adapted to be removed from the screed without removing the hold-down mechanism.

18. A heating element hold-down assembly adapted for use on a screed having a screed frame and a screed plate, said heating element hold-down assembly comprising:

(a) a heating element, said heating element being adapted to be removably mounted on the screed;

(b) a hold-down mechanism, said hold-down mechanism being removably mounted on the screed and comprising:

(i) a hold-down mechanism frame, said hold-down mechanism frame being adapted to contact the heating element;

(ii) a resilient device, said resilient device being adapted to move between an extended position and a retracted position;

(iii) a tension shaft, a portion of said tension shaft being adapted to contact the resilient device;

(iv) a pin, said pin being adapted to removably attach the tension shaft to the hold-down mechanism frame, and being disposed in the lower portion of the tension shaft;

(v) an adjustment means, said adjustment means being adjustably connected to the screed frame so as to contact the tension shaft;

(vi) a means for removably attaching the heating element and the hold-down mechanism;

wherein the hold-down mechanism is adapted to maintain contact between the heating element and the screed plate when the screed moves, flexes, or is adjusted.

19. A method for maintaining contact between a screed plate and a heating element in a screed, said method comprising:

(a) providing a heating element hold-down assembly having a screed frame and a screed plate, said heating element hold-down assembly comprising:

(1) a heating element, said heating element being adapted to be removably mounted on the screed;

(2) a hold-down mechanism, said hold-down mechanism being removably mounted on the screed and comprising:

(i) a hold-down mechanism frame, said hold-down mechanism frame being adapted to contact the heating element;

(ii) a resilient device, said resilient device being adapted to move between an expanded position and a contracted position;

(iii) a tension shaft, a portion of said tension shaft being adapted to contact the resilient device;

(iv) a pin, said pin being adapted to removably attach the tension shaft to the hold-down mechanism frame, and being disposed in the lower portion of the tension shaft;

(v) an adjustment means, said adjustment means being adjustably connected to the screed frame so as to contact the tension shaft;

wherein the hold-down mechanism is adapted to maintain contact between the heating element and the screed plate when the screed moves, flexes, or is adjusted; and, (b) moving the resilient device between the expanded position and the contracted position.

20. The method of claim 19 further comprising adjusting the heating element hold-down mechanism.

* * * * *